US009095191B2

(12) United States Patent
Liebeno

(10) Patent No.: US 9,095,191 B2
(45) Date of Patent: Aug. 4, 2015

(54) STOCKFIT ASSEMBLY FIXTURE FOR SHOE PRODUCTION

(75) Inventor: Bret Liebeno, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 94 days.

(21) Appl. No.: 13/122,707

(22) PCT Filed: Sep. 28, 2009

(86) PCT No.: PCT/US2009/058626

§ 371 (c)(1),
(2), (4) Date: Jun. 10, 2011

(87) PCT Pub. No.: WO2010/037034

PCT Pub. Date: Apr. 1, 2010

(65) Prior Publication Data

US 2011/0232009 A1 Sep. 29, 2011

Related U.S. Application Data

(60) Provisional application No. 61/194,352, filed on Sep. 26, 2008.

(51) Int. Cl.
*A43D 3/00* (2006.01)
*A43D 23/04* (2006.01)
(Continued)

(52) U.S. Cl.
CPC ..... *A43D 23/04* (2013.01); *A43D 25/06* (2013.01); *A43D 25/10* (2013.01); *A43D 86/00* (2013.01); *A43B 9/12* (2013.01)

(58) Field of Classification Search
CPC ..... A43D 5/02; A43D 21/08; A43D 21/16; A43D 21/10; A43D 23/02; A43D 23/022; A43D 25/00; A43D 25/06; A43D 25/18; A43D 35/00; A43D 83/00; A43D 86/00; A43D 9/00; A43D 8/00; A43D 23/04
USPC ..... 12/124, 125, 126, 128 R, 128 C, 128 D, 12/145
See application file for complete search history.

(56) References Cited

U.S. PATENT DOCUMENTS 368,496 A * 8/1887 Seaver ..... 12/33
1,167,277 A * 1/1916 Drey ..... 12/22
(Continued)

FOREIGN PATENT DOCUMENTS

EP 296329 A2 * 12/1988
EP 780065 A 6/1997
(Continued)

OTHER PUBLICATIONS

Notification of First Office Action (China) mailed Feb. 28, 2013 in Application No. 200980146899.5; 3 pages.
(Continued)

*Primary Examiner* — Khoa Huynh
*Assistant Examiner* — Megan Brandon
(74) *Attorney, Agent, or Firm* — Shook, Hardy & Bacon L.L.P.

(57) ABSTRACT

A stock fit assembly fixture is provided for aligning and holding into place various portions of a shoe, such as an upper portion, an outsole, and a midsole, while the shoe portions are being assembled. The upper portion of a shoe may be secured to a shoe last, which in turn, may be secured to a top portion of the stock fit assembly fixture. The top portion may be movable such that the upper portion of the shoe can be moved toward the outsole and midsole portions, thus allowing for a securement of the upper portion to the outsole and midsole portions. The movement of the top portion may be by way of a compression mechanism allowing the top portion to be forced to be moved toward a bottom portion of the stock fit assembly fixture.

18 Claims, 4 Drawing Sheets

(51) Int. Cl.

| | |
|---|---|
| ***A43D 86/00*** | (2006.01) |
| ***A43D 25/06*** | (2006.01) |
| ***A43D 25/10*** | (2006.01) |
| *A43B 9/12* | (2006.01) |

(56) References Cited

U.S. PATENT DOCUMENTS

| | | | | | |
|---|---|---|---|---|---|
| 1,494,706 | A | * | 5/1924 | Polleys | 12/126 |
| 2,027,027 | A | * | 1/1936 | Dopp | 12/123 |
| 2,261,219 | A | * | 11/1941 | Brandt | 12/7.3 |
| 2,294,315 | A | * | 8/1942 | Miller | 12/142 C |
| 2,613,394 | A | * | 10/1952 | Doherty | 425/119 |
| 2,759,205 | A | * | 8/1956 | Smith et al. | 12/123 |
| 2,795,822 | A | * | 6/1957 | Long | 264/244 |
| 2,878,523 | A | * | 3/1959 | Hardy | 264/244 |
| 3,005,217 | A | | 10/1961 | Johnston | |
| 3,063,074 | A | * | 11/1962 | Scholl | 12/142 G |
| 3,174,169 | A | | 3/1965 | Lillbob | |
| 3,421,166 | A | * | 1/1969 | Winig | 12/33.6 |
| 3,562,930 | A | | 2/1971 | Kaufman | |
| 3,784,995 | A | * | 1/1974 | Egtvedt et al. | 12/1 A |
| 3,857,129 | A | | 12/1974 | Barre | |
| 3,971,087 | A | | 7/1976 | Giordano | |
| 4,639,693 | A | * | 1/1987 | Suzuki et al. | 333/1 |

FOREIGN PATENT DOCUMENTS

| | | | |
|---|---|---|---|
| GB | 321795 | A | 11/1929 |
| JP | S5084348 | A | 7/1975 |
| JP | 62261304 | A | 11/1987 |

OTHER PUBLICATIONS

Search Report dated Feb. 20, 2013 in Chinese Application No. 200980146899; 2 pages.

* cited by examiner

STOCKFIT ASSEMBLY FIXTURE FOR SHOE PRODUCTION

CROSS-REFERENCE TO RELATED APPLICATIONS

This application claims the benefit of U.S. Provisional Patent Application No. 61/194,352, filed Sep. 26, 2008, entitled "Stockfit Assembly Fixture for Shoe Production."

BACKGROUND OF THE INVENTION

One skilled in the art will recognize that portions of a shoe, including an outsole, midsole, upper portion, and the like, are typically assembled by hand, without the use of a device that may assist in aligning the various shoe portions. For example, the upper portion of a shoe may typically be fitted to a shoe last, and after the application of contact cement or other forms of adhesives, this upper portion may be hand fit to the outsole and midsole. Excess portions of any shoe portions are then cut or stripped off of the assembled shoe, taking more time and operator interaction, in addition to shoe variation, than is needed. Assembling portions of a shoe by hand may create some unintended inconsistencies from shoe to shoe, such as portions that are not aligned as they should be, thus creating a domino effect throughout the shoe manufacturing process from one machine or process to the next. In addition to assembling shoe portions by hand, press blocks may be used but also do not provide the functional advantage of aligning the various shoe portions prior to assembly.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present invention is directed toward a stock fit assembly fixture that holds into place and therefore aligns the upper portion of a shoe, which may be placed on or fit to a last so that the upper portion can be secured to other portions of the shoe, such as a midsole and outsole. In one embodiment, the stock fit assembly fixture is comprised of a base plate, a bottom plate, a guide plate, and a top plate, wherein a shoe last and the shoe portions are located between the bottom and guide plates. Further, the base plate and the guide plate are connected by way of two guide pins, each of which is encased by a spring, allowing for the guide plate and the top plate to move downward by way of force applied by an operator, for example, such that the upper portion of a shoe may be compressed or fit to the outsole and midsole portions.

Embodiments of the present invention provide for the described stock fit assembly to be utilized in a single piece flow, wherein one shoe out of a pair of shoes is assembled at one time. This provides a great advantage in that it allows for a customer to truly have a customized shoe manufacturing experience, as one shoe may be different from the other. As many people have foot sizes that are slightly different, each shoe of a pair may be sized accordingly, thus providing a custom fit. Further, in the case that a customer prefers different materials on each shoe, or different visual customization, the use of the single piece flow (e.g., single shoe), as opposed to a double flow (pair of shoes), provides this opportunity. Traditionally, shoes have been manufactured in matched pairs, whereas here, the left and the right shoe may be manufactured separately, thus allowing for individual customization, whether visual or involving how a shoe fits a customer (e.g., size, hardness in different areas of the shoe, width).

Other embodiments provide a stock fit assembly fixture that is used during a shoe manufacturing process. The stock fit assembly fixture may include a base member, a top member, and a holding mechanism for holding a portion of a shoe to the base member, and also for holding a shoe last to the top member so that as various portions of the shoe are assembled, the shoe portion remains fixed relative to the base member. Also, the shoe last may remain fixed relative to the top member to thereby reduce assembly variation from shoe to shoe. In one embodiment, the top member may include a guide plate and a top plate, and the base member may include a base plate and a bottom plate.

BRIEF DESCRIPTION OF THE DRAWING

The present invention is described in detail below with reference to the attached drawing figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

Embodiments of the invention provide systems and methods for use with a stock fit assembly fixture, which is generally comprised of a top member and a bottom member. The bottom member may include a bottom plate and a base plate, and the top member may include a guide plate and a top plate that move up and down as compression or force is applied to the top member. A compression mechanism allows for the top member to be moved toward the base member to allow for a first and a second shoe portion to make contact. Between a top member and a bottom member may be a shoe last around which an upper portion of a shoe is placed, and a bottom portion of a shoe, which may include in some embodiments an outsole and a midsole. Prior to being placed between the top and bottom members, the upper portion of a shoe may be placed on or around the shoe last. The shoe last may then be secured to the top member by a securing mechanism, such as bolts, screws, dowel pins, or the like. Prior to a compression force being applied from the top member to the bottom member, the shoe last may not have contact with the bottom portion of the shoe. Once compression is applied to the top member, the upper portion is forced onto the bottom portion. As mentioned the bottom portion may include an outsole and a midsole. In one embodiment, the outsole and midsole have already been secured or fitted together prior to being put into the stock fit assembly fixture. In another embodiment, however, the stock fit assembly fixture is used to secure or fit the outsole and the midsole together, in addition to securing the upper portion to the outsole/midsole portion.

Figure 1:
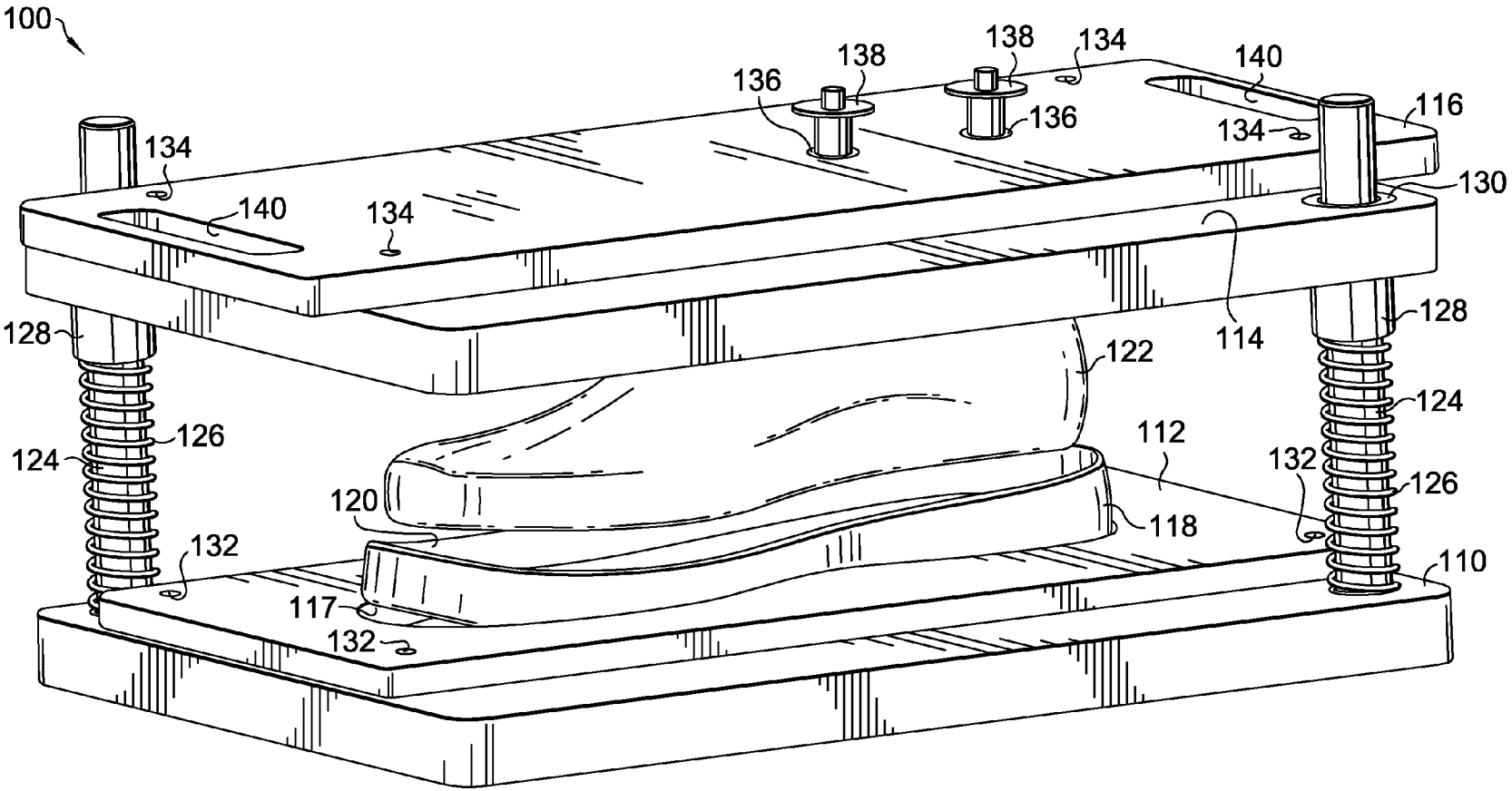
FIG. 1 illustrates a perspective view of a stock fit assembly fixture for manufacturing a shoe, in accordance with an embodiment of the present invention.

Referring now to FIG. 1, a perspective view of a stock fit assembly fixture used in the shoe manufacturing process is provided, in accordance with an embodiment of the present invention. Initially, the stock fit assembly fixture comprises four plates, each providing a unique function in aligning the shoe portion and ensuring that the finished product is reproducible, thus substantially eliminating variation in the finished product. The stock fit assembly fixture may be used in a portion of an overall process of manufacturing a shoe. For example, a manufacturing process may, in some embodiments, include the individual manufacture of an outsole, a midsole, and an upper portion that, when combined, form the finished product, such as a completed shoe. The stock fit assembly fixture, specifically, may be used once each of the individual portions, such as an outsole, a midsole, and an upper portion, have been completed. This may be after each portion has been through various processes, such as, but not limited to, printing, laser, embroidery, forming, and stitching.

As stated above, the stock fit assembly fixture may be used to substantially eliminate variation in the shoe manufacturing process by minimizing operator interaction in conjunction with assembling and fitting various portions of a shoe. Ultimately, this may allow for a better prediction of the quality of a finished shoe product, thus minimizing mistakes and errors due to operator interaction.

With continued reference to FIG. 1, the four plates illustrated include a base plate 110, a bottom plate 112, a guide plate 114, and a top plate 116. It will be understood that while four plates are illustrated in FIG. 1, any number of plates may be used in conjunction with the present invention. For example, in one embodiment, the guide plate 114 and the top plate 116 may be combined and one plate may be used to perform the functions of both plates. In addition, it will be understood that while the plates shown in FIG. 1 are illustrated in certain proportions to one another, each plate may vary in size, including length, width, and thickness (e.g., height). Plate dimensions may vary based on shoe size or type of shoe, which may include a basketball shoe, a skate shoe, a running shoe, etc.

Figure 2:
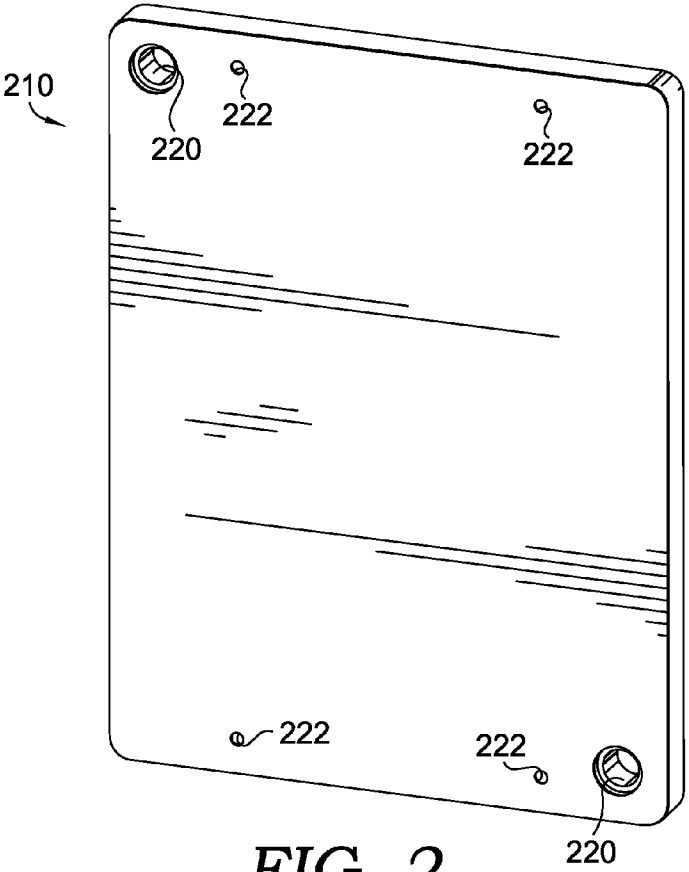
FIG. 2 illustrates an enlarged perspective view of a base plate having multiple guide pin holes, in accordance with an embodiment of the present invention.

To more accurately describe the base plate 110, an enlarged perspective view of the base plate 110 is illustrated in FIG. 2, in accordance with an embodiment of the present invention. Here, the base plate 210 includes two base pin holes 220 and a plurality of base plate holes 222. Four base plate holes 222 are illustrated in the embodiment of FIG. 2, although it is contemplated to be within the scope of the present invention that any number of holes may be provided to allow for the joining of the base plate 110 to the bottom plate, shown as item 112 in FIG. 1. The base pin holes 220 allow for the insertion of a bottom surface of guide pins 124, illustrated in FIG. 1. These guide pins 124 extend upwardly from the base plate 110. In one embodiment, each guide pin 124 is surrounded by a spring 126 that acts as a compression mechanism for securing an upper shoe portion to a lower portion, which may include, in one embodiment, an outsole and a midsole.

Once the stock fit assembly fixture 100 has been assembled (e.g., the upper portion on the last and the outsole/midsole are between the plates), as illustrated in FIG. 1, an operator may use the handles located on the top plate 116 and use force, or press down on the top plate 116 to compress the upper portion on the last 122 into the midsole 120 and outsole 118 portions. The midsole 120 and the outsole 118 may be collectively referred to as a stock fit assembly, as they may have already been put together (e.g., heat pressed, adhesive) prior to use in conjunction with the stock fit assembly fixture 100. While in one embodiment, an operator or other user may be performing the actual and initial compression of the upper portion to the outsole/midsole portions, in another embodiment, a machine may be used to perform this same function, which may alleviate operator interaction with the compression function of the stock fit assembly fixture 100.

The base plate 210 includes a top surface, a bottom surface, and surrounding edges. As previously mentioned, the size, including a length, a width, and a height, of the base plate 210 may vary. The base plate 210 may be made from a number of materials including plastic or metal (e.g., aluminum), or any other material that will allow for compression or force to be placed upon it without the material bending or giving out in any way.

Directly above the base plate 110 may be the bottom plate 112, which provides a frame, or an outsole frame 117 that is cut out from the bottom plate 112 such that an outsole, such as outsole 118, may fit into the framed, or cutout space. As the outsole 118 may vary in size depending on a shoe size or even a type of shoe (e.g., running shoe, skate shoe, basketball shoe), multiple bottom plates 112 may be available to provide an appropriate fit for the outsole 118 being assembled and fit at that particular time. However, in one embodiment, one bottom plate 112 may be used across various shoe sizes and shoe types with added functionality of multiple sliders, for instance, that allow for change in size of the outsole frame 312, illustrated in FIG. 3. The bottom plate 112 includes one or more bottom plate holes 132 to secure the bottom plate 112 to the base plate 110. Four bottom plate holes 132 are shown in the embodiment of FIG. 1.

Figure 6:
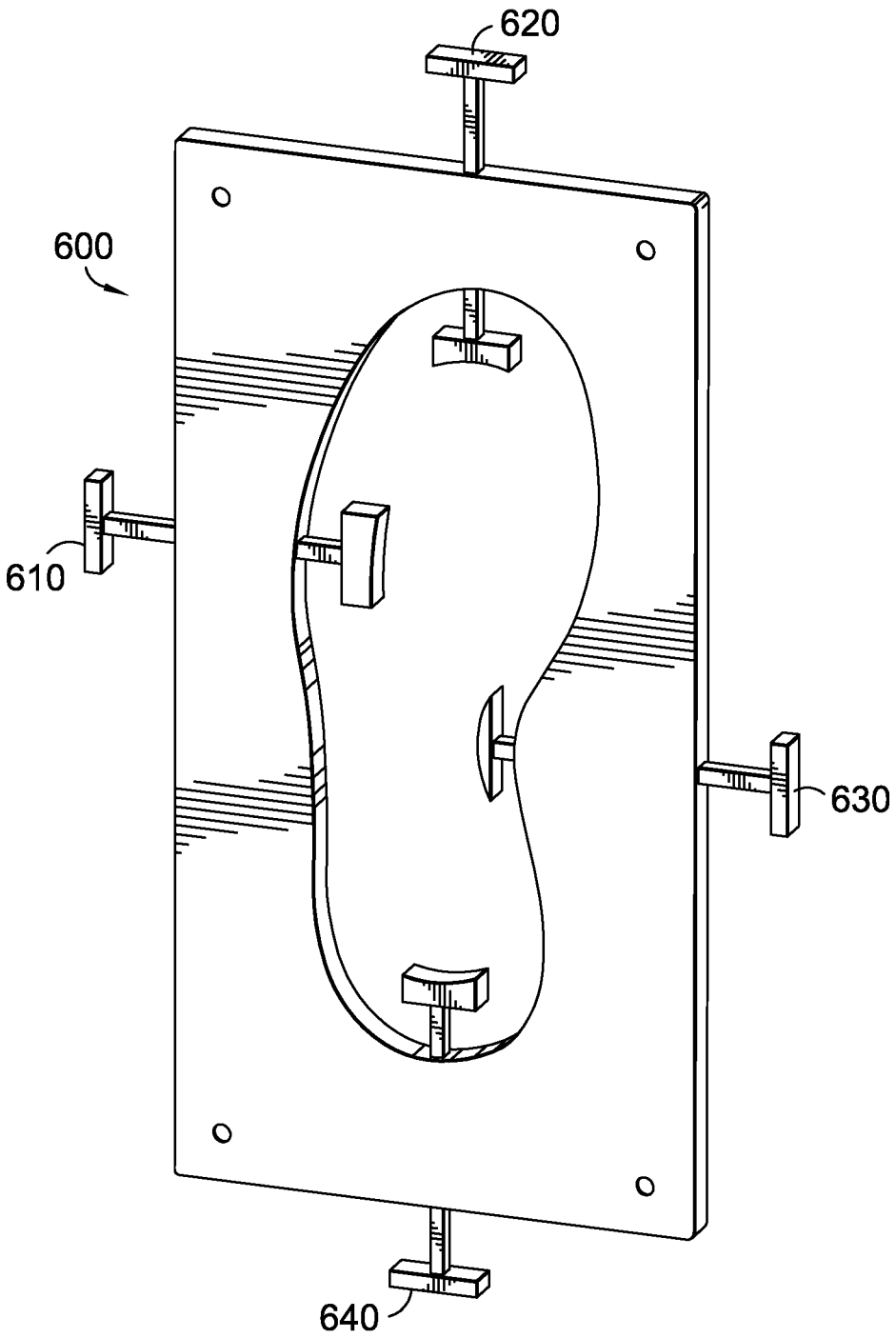
FIG. 6 illustrates an enlarged perspective view of the guide plate having multiple adjustable sliding mechanisms used to adjust the dimensions of the outsole framed portion of the guide plate.

FIG. 6 illustrates a mechanism for allowing one bottom plate to be used instead of creating the need for multiple bottom plates, and thus eliminating a substantial amount of material, and possibly operator interaction. The bottom plate 600 is shown with adjustable mechanisms (four shown here) that slide in and out, depending on the shoe type and/or size. While sliding mechanisms (e.g., sliding tabs) are illustrated in the embodiment of FIG. 6, it will be appreciated that other mechanisms that allow for a smaller, larger, or different type of outsole/midsole to be placed within the cutout area of the bottom plate 600 may also be used. Sliding mechanism 610 may be located on the outer portion (e.g., outside lateral) of the framed area, and may help adjust this area in situations, such as, when a width or length of a shoe needs to be adjusted. Sliding mechanism 610 may also be adjusted based on a shoe size or shoe type, as some shoes provide for wider outsoles than others. Sliding mechanism 620 may be located on a top portion of the bottom plate. It assists in allowing for variances in length of an outsole. Sliding mechanism 630 may be located on the inner arch portion (e.g., medial lateral) of the framed area to assist with variances in the width of a shoe. Next, sliding mechanism 640 may be located on the bottom, near the heal portion of the framed area, and may also assist in variances of a shoe length. Other sliding mechanisms may be provided. For instance, in one embodiment, more than four mechanisms may be used to properly adjust the size of the framed area. In another embodiment, less than four may also be utilized and still provide the same functionality.

Figure 3:
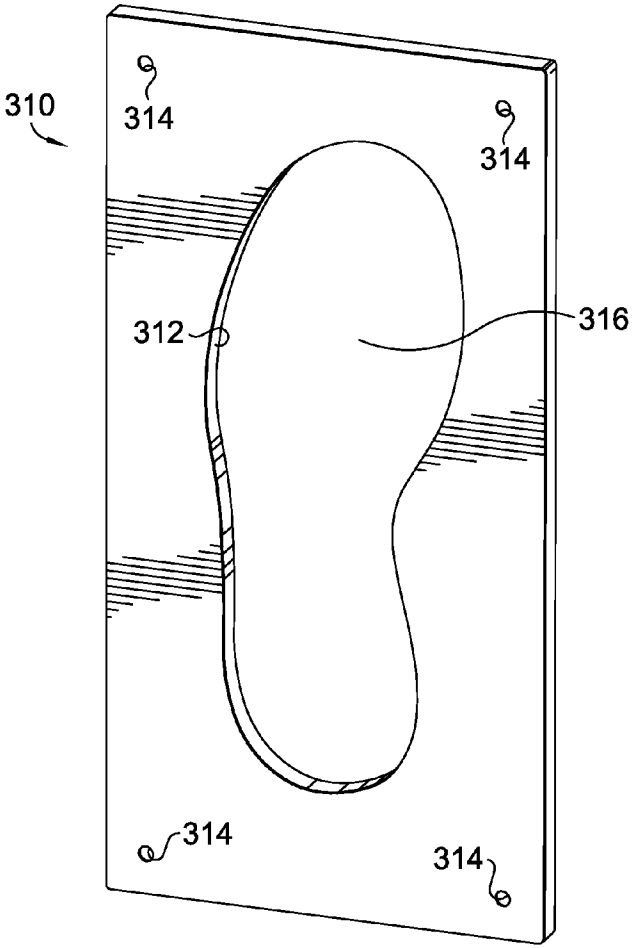
FIG. 3 illustrates an enlarged perspective view of a bottom plate having an area for insertion of an outsole, in accordance with an embodiment of the present invention.

An enlarged perspective view of the bottom plate 112 is illustrated in FIG. 3, in accordance with an embodiment of the present invention. As mentioned, the bottom plate shown in FIG. 3 as item 310 may be one unitary plate comprising an outsole frame 312, which frames and/or defines essentially what may be referred to as a cutout portion, opening, and/or cavity 316 that is within the plate that may be sized according to the size of the particular outsole currently being fit and assembled. The outsole 118 may fit directly into the outsole frame 312. The bottom of the outsole 118 may be in contact with a top surface of the base plate 110. Similar to the base plate 110, the bottom plate 310 comprises a plurality of bottom plate holes 314 that may be in alignment with the base plate holes 222 of FIG. 2. Together, these holes provide for the insertion of a securing mechanism through each plate to secure the bottom plate 310 and the base plate 110 to each other. Examples of securing mechanisms include, but are not limited to, a screw, bolt, or dowel pin to hold the base plate 110 and bottom plate 112 in place in relation to each other. Other embodiments may employ other types of securing mechanism that would provide this same functionality.

The bottom plate 310 includes a top surface, a bottom surface, and surrounding edges, including the internal edges that form the outsole frame 312. The size, including a length, a width, and a height, of the base plate may vary depending on the shoe size and even the type of shoe being assembled at the current time. The bottom plate 310 may be made from a number of materials including plastic or metal (e.g., aluminum), or any other material that is suitable to allow for compression or force to be placed upon it without the material bending or giving out in any way.

Returning to FIG. 1, a midsole 120 is shown inside the outsole 118, and in some embodiments, the midsole 120 and the outsole 118 have already been joined by the time they are placed onto the stock fit assembly fixture. Illustrated above the outsole 118 and midsole 120 is last 122, which is used to form an upper portion of a shoe to the shape of a human foot. Prior to the stock fit assembly fixture being assembled, the upper portion is placed on the last. The last 122, like the bottom plate 112, may be available in various sizes, depending on the particular size of the shoe being manufactured at that time or the type of shoe.

Figure 4:
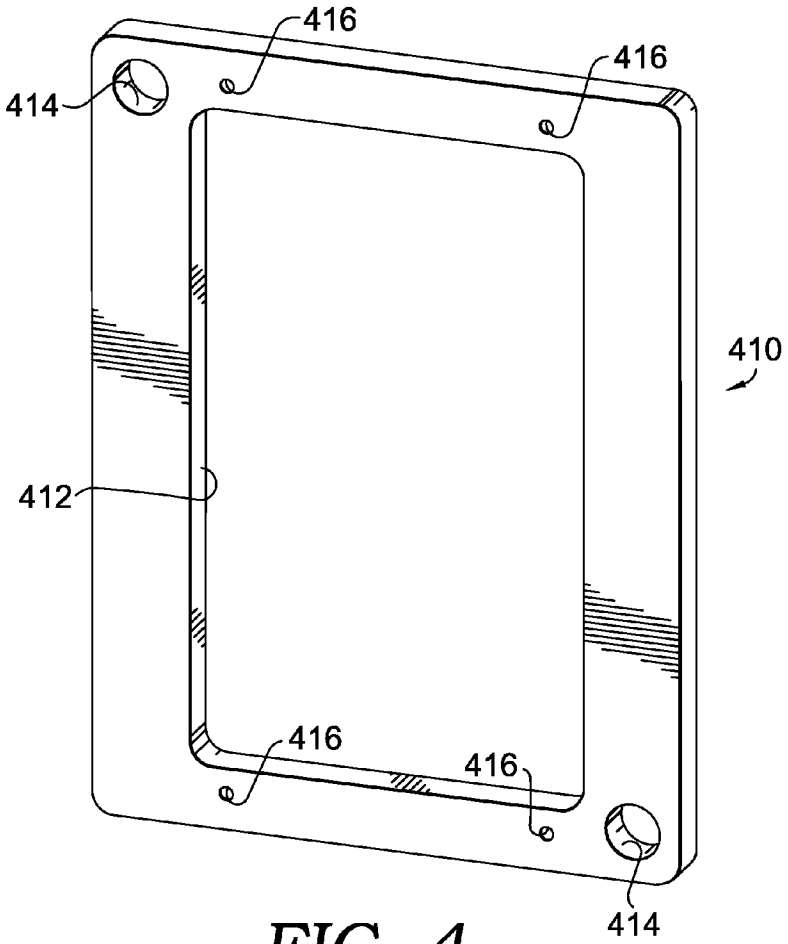
FIG. 4 illustrates an enlarged perspective view of a guide plate having multiple guide pin holes and an area through which a last is positioned, in accordance with an embodiment of the present invention.

Above the last 122 is a guide plate 114 through which the last 122 is placed. To better facilitate a detailed discussion of the guide plate 114, FIG. 4 is provided to illustrate an enlarged perspective view of the guide plate, shown as item 410, in accordance with an embodiment of the present invention. The guide plate 410 comprises a framed area 412 that allows for an opening through which a top portion of the last 122 of FIG. 1 is positioned. While in one embodiment, the framed area 412 may be a rectangular shape, in other embodiments, the framed area 412 may take the form of another shape, such as, but not limited to, circular, square, oval, triangular, etc. Further, the framed area 412 may be any of a number of sizes, which may depend on the shoe size, the type of shoe being manufactured, etc.

The guide plate 410 also includes two pin holes 414 that provide an opening for the guide pins 124, as shown in FIG. 1. Returning to FIG. 1, as previously mentioned, the springs 126 surrounding the guide pins 124 act as a compression mechanism that allow for the top plate to be moved downward, which provides for compression of the outsole 118 and the midsole 120. In one embodiment, other shoe portions or components other than those depicted in FIG. 1 utilize the stock fit assembly fixture 100.

FIG. 1 also illustrates two compression members 128 that are located directly above the springs 126, and are sized such that the inside diameter of each compression member 128 is greater than the inside diameter of the top pin holes 130. This difference in inside diameters allows for the compression member 128 to be positioned below the top pin hole 130 at all times such that the compression members 128 transfer pressure from the compression action onto the springs 126.

Referring back to FIG. 4, the guide plate 410 also comprises a plurality of guide plate holes 416 used to secure a top plate 116, shown in FIG. 1, into place. The guide plate 410 includes a top surface, a bottom surface, and surrounding edges, including the outer edges of the framed area 412. The size, including a length, a width, and a height of the guide plate may vary depending on a size or type of shoe (e.g., basketball shoe, running shoe, skate shoe). The guide plate 410 may be made from plastic or metal (e.g., aluminum), or any other material that will allow for compression or force to be placed upon it without the material bending or giving out in any way.

Figure 5:
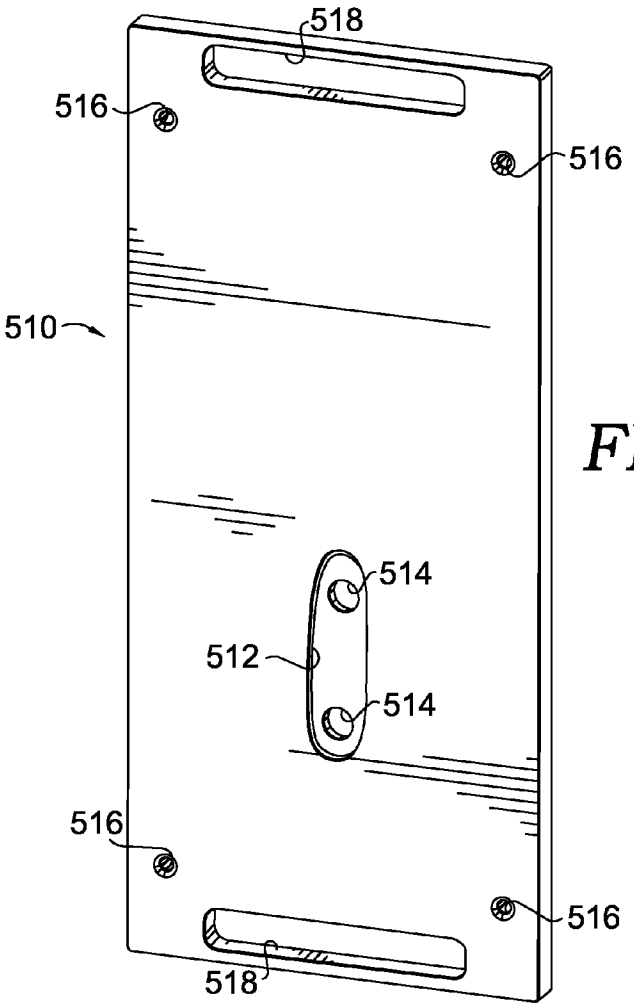
FIG. 5 illustrates an enlarged perspective view of a top plate having multiple last pin holes, in accordance with an embodiment of the present invention.

The fourth plate that comprises the stock fit assembly fixture is the top plate 116, which is further illustrated in FIG. 5. FIG. 5 is an enlarged perspective view of the top plate, illustrated as item 510, in accordance with an embodiment of the present invention. The top plate 510 comprises a recessed area 512, wherein the recessed area 512 includes two top recessed plate holes 514. These holes allow for the insertion of a securing mechanism, such as bolts, dowel pins, screws, or the like. The securing mechanism secures the top plate 510 directly to a top portion of the last 122. This keeps the last 122, shown in FIG. 1, in position throughout the assembly process. The top plate 510 also comprises a plurality of top plate holes 516 (four shown in FIG. 5) that secure the top plate 510 to the guide plate 410 by way of the guide plate holes 416, as previously described. In order to provide for an efficient process using the stock fit assembly fixture 100, there are two top plate handles 518 located on either side of the top plate 510. The top plate handles 518 allow for easy placement or removal of the top plate when the stock fit assembly fixture is either being assembled or disassembled.

In one embodiment, the top plate 510, shown in FIG. 5, may be manufactured such that a different top plate is used for each different shoe size, different shoe type, etc. However, in one embodiment, the top plate 510 may remain consistent even for different shoe types and sizes. This may depend on the last, as the holes in the top of the last may consistently align with the top recessed plate holes 514. The holes may also align with the top plate such that the last is also in alignment with the outsole frame 312 shown in FIG. 3, no matter the shoe size or shoe type. In this regard, it is contemplated to be within the scope of the present invention that either one top plate may be used consistently across various shoe sizes and shoe types, or multiple top plates may be used, and would vary depending on shoe size and type.

Returning to FIG. 1, the top plate holes previously described are shown as items 134, and the top plate handles are shown as items 140. In addition to using the top plate handles 140 in assembling and disassembling the stock fit assembly fixture 100, the handles 140 may also be used by an operator, for example, to apply force to the top plate 116 to compress the last 122, surrounded by the upper portion, into the midsole/outsole, which provides for at least an initial securement of the upper portion to the outsole and midsole. Once this at least initial securement is made, the assembled shoe may be removed from the stock fit assembly fixture 100 and may be placed in a press, such as a machine press, for further securement of the upper to the midsole and outsole.

Referring back to FIG. 5, the top plate 510 includes a top surface, a bottom surface, and surrounding edges. The size, including a length, a width, and a height, of the top plate 510 may vary depending on a shoe size (e.g., dimensions, including height, length and width of the shoe) or a shoe type (e.g., running shoe, skate shoe, basketball shoe). The top plate 510 may be made from plastic or metal (e.g., aluminum), or any other suitable material that will allow for compression or force to be placed upon it without the material bending or giving out in any way.

With continued reference to FIG. 1, items 136 are the top plate holes that allow for the last pins 138 to provide a securing mechanism for securing the top plate 116 to the last 122, and thus align the top plate 116 to the top portion of the last 122. As previously mentioned, the upper shoe portion is placed on the last prior to the top plate 116 being secured to the last 122. Once the last pins 138 are secured to the top plate 116 and the last 122, the assembly and compression may take place.

The present invention has been described in relation to particular embodiments, which are intended in all respects to be illustrative rather than restrictive. Alternative embodiments will become apparent to which the present invention pertains without departing from its scope. For example, the inventions described herein may be readily applied to manufacturing any type of footwear including dress shoes, sandals, all types of boots, or any other type of footwear. Furthermore, aspects hereof may be readily adapted to any traditional manufacturing process where reducing variation due to operator interaction is desired.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and is within the scope of the claims.

What is claimed is:

1. A stock fit assembly fixture for use during a shoe manufacturing process, the stock fit assembly fixture comprising:

a bottom plate comprising at least two bottom plate holes and having a framing cutout that is configured to frame and -hold a second portion of a shoe, in place;

a top member comprising a top plate and a guide plate, the guide plate comprising at least a first pin hole, the top member in alignment with a base plate, the base plate comprising at least a second pin hole extending through the base plate and at least two base plate holes in alignment with the at least two bottom plate holes for securing the bottom plate on top of the base plate by a first securing mechanism;

at least one guide pin surrounded by a spring inserted through the at least first pin hole of the guide plate and the at least second pin hole of the base plate; and a second securing mechanism for securing a shoe last to the top member, such that the shoe last remains fixed relative to the top member and in alignment with the framing cutout of the bottom plate during assembly of the shoe, wherein the second portion of the shoe remains fixed within the cutout of the bottom plate, relative to the base plate, such that a bottom surface of the second portion of the shoe is in contact with a top surface of the base plate during assembly of the shoe.

2. The stock fit assembly fixture of claim 1, wherein the portion of the shoe is an outsole.

3. The stock fit assembly fixture of claim 1, wherein the shoe last is secured to the top member by one or more pins that protrude through the top member and through at least a portion of the shoe last.

4. The stock fit assembly fixture of claim 1, wherein the top member is comprised of a guide plate and a top plate that are secured to each other.

5. The stock fit assembly fixture of claim 1, further comprising a compression mechanism that allows for the top member to be moved toward the base plate to provide for a first portion of the shoe, that is secured to the top member to make contact with the second portion of the shoe, that is secured to the base plate.

6. The stock fit assembly fixture of claim 5, wherein the compression mechanism comprises one or more springs that allow the top member to be moved along a vertical axis in relation to the base plate.

7. The stock fit assembly fixture of claim 1, wherein the cutout of the bottom plate includes one or more adjustable mechanisms for adjusting the size of the cutout, thus allowing for a variance in a size of the shoe and a type of the shoe.

8. The stock fit assembly fixture of claim 7, wherein the one or more adjustable mechanisms can be moved so as to slide in and out of the cutout such that a width and a length of the cutout can vary according to the size of the shoe and the type of the shoe.

9. A stock fit assembly fixture for use during a shoe manufacturing process, the stock fit assembly fixture comprising:

a bottom plate comprising at least two bottom plate holes, the bottom plate having a cavity within the bottom plate itself, wherein the cavity is configured to hold a second shoe portion, wherein a bottom surface of a second shoe portion is in contact with a top surface of a base plate;

the base plate comprising at least two base plate holes in alignment with the at least two bottom plate holes for securing the bottom plate to the base plate by a first securing mechanism, and at least a first pin hole extending through the base plate and;

a top member comprising a top plate and a guide plate, the guide plate comprising at least a second pin hole, and the guide plate having a shoe last secured thereon;

at least one guide pin surrounded by a spring inserted through the at least first pin hole and the at least second pin hole of the guide plate; and wherein the guide pin is a part of a compression mechanism that allows the top member to be moved toward the base plate such that a first shoe portion secured to the shoe last of the top member makes contact with the second shoe portion when the top member is substantially moved toward the base plate.

10. The stock fit assembly fixture of claim 9, wherein the first shoe portion is an upper portion of a shoe that is secured to the shoe last, and wherein the second shoe portion is an outsole portion of the shoe.

11. The stock fit assembly fixture of claim 9, wherein the compression mechanism is comprised of one or more guide pins, each of the one or more guide pins having an attached spring to allow for movement of the top member toward the base plate.

12. The stock fit assembly fixture of claim 9, further comprising a securing mechanism for holding the first shoe portion to the top member.

13. The stock fit assembly fixture of claim 12, wherein the securing mechanism includes one or more pins that secure in place the top member to a shoe last, around which the first shoe portion is placed.

14. The stock fit assembly fixture of claim 9, wherein the cavity is configured to frame the second shoe portion.

15. The stock fit assembly fixture of claim 9, wherein one or more adjustable mechanisms allow for a size variance of the cavity of the bottom plate, and wherein the size variance includes one or more of a length or a width of a shoe.

16. A method for contacting various shoe portions together in a shoe manufacturing environment, the method comprising:

securing a first shoe portion to a base plate by placing the first shoe portion within a cavity of a bottom plate itself, wherein the bottom plate comprises at least two bottom plate holes and the base plate comprises at least two base plate holes and at least a first pin hole, further wherein the bottom plate holes and the base plate holes are in alignment for securing the bottom plate to the base plate such that a bottom surface of the first shoe portion is in contact with a top surface of the base plate;

securing a second shoe portion to a shoe last, the shoe last being secured to a top member, wherein the top member comprises a top plate and a guide plate, the guide plate comprising at least a second pin hole, wherein the top member is in alignment with the base plate, and further wherein a guide pin surrounded by a spring is inserted through the at least the first pin hole of the base plate and the at least the second pin hole of the guide plate; and pressing the top member down toward the base plate to allow for the first and second shoe portions to make contact.

17. The method of claim 16, wherein the cavity is configured to frame the first shoe portion.

18. The method of claim 16, further comprising adjusting one or more adjustable mechanisms within the cavity of the bottom plate that allow for the cavity of the bottom plate to accommodate a plurality of sizes for the first shoe portion, the plurality of sizes to be varied depending on a width and a length of the first shoe portion.

* * * * *